United States Patent [19]

Greenhow

[11] Patent Number: 4,664,455

[45] Date of Patent: May 12, 1987

[54] LIDLESS GARBAGE BAG HOLDER

[76] Inventor: James G. Greenhow, 229 Goodram Drive, Burlington, Ontario, Canada, L6L 2J6

[21] Appl. No.: 737,595

[22] Filed: May 24, 1985

[51] Int. Cl.[4] ..... A47B 81/00

[52] U.S. Cl. ..... 312/211; 248/95; 248/99; 312/212; 312/237; 312/275

[58] Field of Search ..... 312/211, 212, 237, 238, 312/275; 248/99, 95, 101

[56] References Cited

U.S. PATENT DOCUMENTS

| | | | |
|---|---|---|---|
| 2,363,699 | 11/1944 | Smith | 312/163 |
| 3,226,070 | 12/1965 | Kurlander | 248/97 |
| 3,323,714 | 6/1967 | Lewis | 232/43.2 |
| 3,653,619 | 4/1972 | Plum | 312/275 |
| 3,724,921 | 4/1973 | Lake | 312/237 |
| 3,893,615 | 7/1975 | Johnson | 248/95 X |
| 4,062,604 | 12/1977 | Popper | 312/211 |

FOREIGN PATENT DOCUMENTS

| | | | |
|---|---|---|---|
| 2709836 | 9/1978 | Fed. Rep. of Germany | 312/211 |
| 2928653 | 2/1981 | Fed. Rep. of Germany | 312/211 |

*Primary Examiner*—James T. McCall
*Attorney, Agent, or Firm*—Rogers & Scott

[57] ABSTRACT

A lidless garbage bag holder for mounting on the inside vertical surfaces of cupboard doors is described. In a preferred embodiment, the bag holder has a frame portion fixed to the door and a movable portion coupled pivoted to the fixed portion, the movable portion automatically moving to the open position as the door opens and to the closed position as the cupboard door is closed by engagement between a leading portion of the movable portion such as a horizontal rod, and a ramp mounted on the cabinet floor. The closure ramp also provides means to keep the door firmly shut when it is in the closed position. The bag holder has handle receiving portions with friction fit caps and can accomodate bags with and without handles, the friction fit caps holding the bags without handles on the frame portions. In an alternative embodiment the ramp is part of the leading portion of the movable frame portion.

7 Claims, 8 Drawing Figures

LIDLESS GARBAGE BAG HOLDER

This invention relates to lidless garbage bag holders and particularly, but not exclusively, to lidless garbage bag holders for mounting inside cupboard doors, for example under sinks and the like.

A garbage bag holder should have a number of desirable features in addition to being inexpensive and lightweight. For example, it should not obstruct access to the cupboard interior when the door is opened and should be capable of being used with bags made of different material, for example plastic, paper and the like with or without handles. In addition, the garbage bag holder should open the bag automatically when the door opens and vice versa. It should also permit easy insertion and removal of bags and in use it should firmly retain the bag even when the bag is full and heavy so that garbage spillage is avoided. Furthermore, the garbage bag holder should act to 'lock' the door in the closed position to prevent inadvertent opening, even when the bag is full and heavy.

Most garbage bag holders for mounting on the inside of cupboard doors and the like are made of a wire frame and have a lid. Bags are fitted and dropped over the frame and the lid is then closed over the frame and the bag. With these bag holders when the bag is heavy it tends to unwrap and slip off the frame so that spills of garbage inside the cupboard are common, resulting in a mess and hygiene problems. Generally such garbage bag holders do not open or close when the door opens and closes and it is often difficult and inconvenient for the elderly and the disabled to use such bag holders. Furthermore, the lid is usually lightweight plastic and frequently the lid does not fit in the frame and this can result in the escape of unpleasant odours.

One proposed lidless garbage bag holder is disclosed in U.S. Pat. No. 4,062,604 to Popper which issued on Dec. 13, 1977. This bag holder comprises a frame with a first part that is fixed to the door and a second part which is pivotably mounted to the first part. The second part is also connected to the inside wall of the cupboard by a traction rod. When the door is pulled open, the traction rod pulls the pivotable part of the garbage bag holder to open the garbage bag and the garbage is then dropped into the bag and when the door is closed the traction rod forces the top of the bag closed.

This structure has a number of disadvantages, for example, the placement of the traction rod limits access to the interior of the cabinet and also requires careful mounting inside the cabinet wall. Furthermore, to mount and use this device requires that there is a central cabinet wall and therefore this structure cannot be used underneath a double-door sink cabinet unless a separate cabinet wall is provided. Also, the only bags capable of being used with this bag holder are those having handles which are placed over hooks located on the fixed and moveable parts of the garbage bag holder. A further disadvantage is that there is no provision for the garbage bag holder retaining the door closed when the bag is heavy. With this structure the weight of the bag often causes the door to sit slightly ajar; this is annoying and requires continual closing of the door, or removal of the bag when it is not full.

An object of the present invention is to provide an improved lidless garbage bag holder which obviates or mitigates the abovesaid disadvantages.

This is achieved by using a bag holder which mounts inside a cupboard door and can receive bags with or without handles. The frame opens and closes the bag as the door opens and closes by the frame cooperating with a holder closing member mounted inside the door frame.

Accordingly, in one aspect of the present invention there is provided a lidless garbage bag holder comprising: a fixed frame portion for securement to the inside vertical surface of a cupboard door mounted on a cabinet frame, said cabinet frame having a base and a cabinet floor; a movable frame portion for coupling to the fixed frame portion and pivotably movable about a pivot axis relative to the first frame portion; said fixed and movable frame portions having garbage bag holding means for receiving a garbage bag; said movable frame portion having a ramping portion spaced from said pivot axis; and cooperating with garbage bag holder closure means adapted to be coupled to said cabinet frame for engaging said movable frame portion, so that as said cupboard door is opened and closed engagement between said movable frame portion ramping means and said garbage bag closure means opens and closes said garbage bag holder respectively.

In the preferred embodiment, an open wire frame is provided and defines a bag receiving space and said first frame portion supports a removable base tray for supporting said garbage bag and catching any liquids which might leak through the bag when inserted into said bag holder. The garbage holder closure ramp means mounted on the cupboard base has an upwardly inclined ramp surface for engaging a horizontal rod constituting the ramping portion, and a shorter downwardly inclined ramp surface such that when the door is closed the movable rod on the second frame portion rides up the upwardly inclined ramp surface to close the bag and over a crest onto the downwardly inclined ramp surface which acts as a lock to keep the garbage bag holder firmly closed and the cupboard door firmly shut in the closed position.

These and other aspects of the invention will become apparent from the following description when taken in combination with the accompanying drawings in which.

Figure 1:
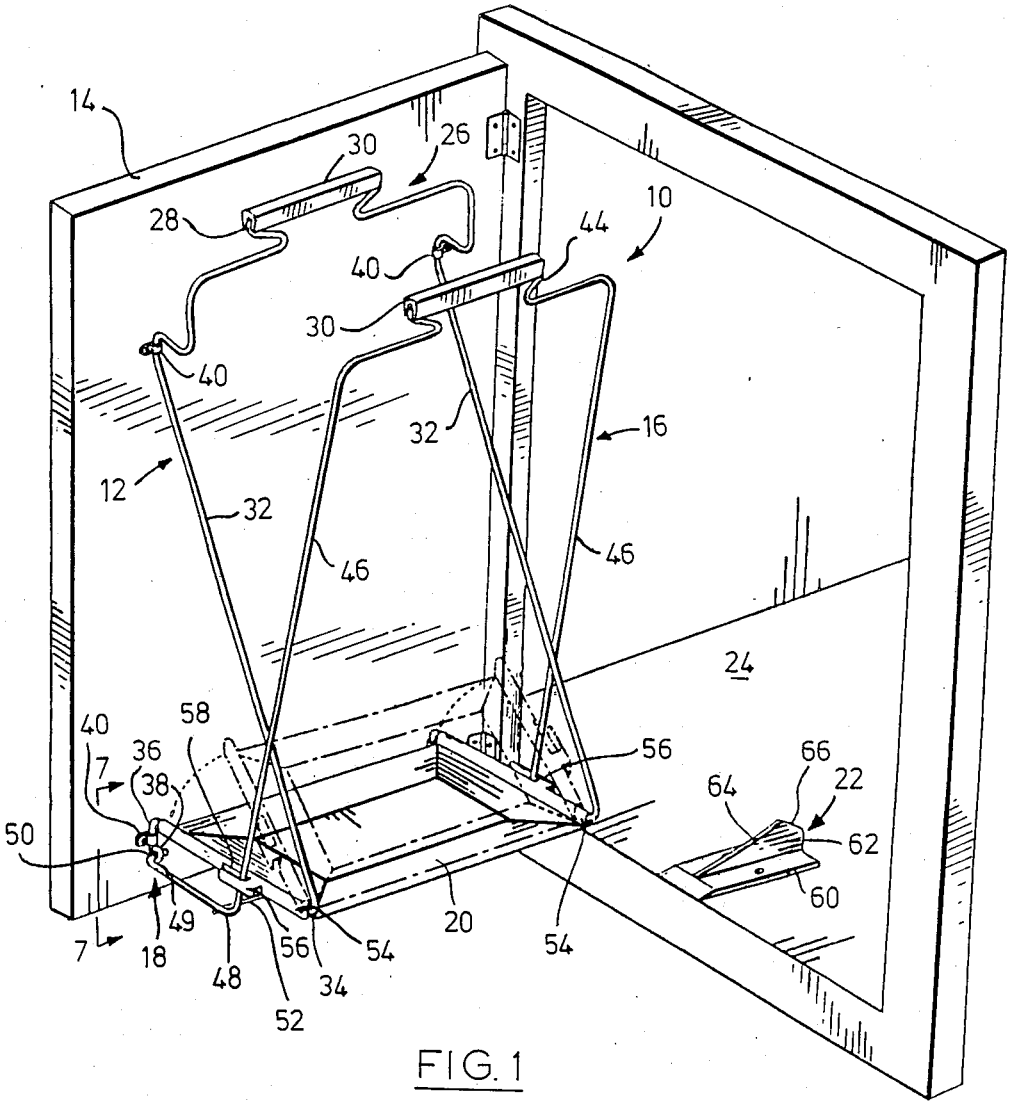
FIG. 1 is a perspective view of a cupboard with a door open showing a garbage bag holder according to a preferred embodiment of the invention mounted on the inside surface of the cupboard door.

Reference is first made to FIG. 1 of the drawings which shows a lidless garbage bag holder generally indicated by reference numeral 10 which consists of a fixed frame portion 12 fixed to a cupboard door 14 and a moveable frame portion 16 which is pivotally mounted at locations 18 to the fixed frame portion. A removable base tray 20 is mounted at the bottom of the fixed frame portion. Inside the cupboard a bag holder closure ramp 22 is fixed to the base 24 of the cupboard for engaging movable frame portion 16 to close the garbage bag holder as the door is closed or to permit the garbage bag holder to open as the door is opened as will be later described in more detail.

The fixed frame portion is made of bent wire which can be plastic coated. It consists of a top portion 26 which is bent to form a handle portion 28 to which is tightly fitted a plastic cap 30 of generally U-shaped cross-section for securing bags without handles to the frame as will be described. The top portion blends into two wire side members 32 which are angled outwardly from the plane of the door. The wire side members 32 are then bent sharply back toward the inner door surface to form horizontal members 34 on which the removable base tray is supported, and the horizontal members being bent 90° downwardly at their respective ends to form shorter vertical portions 36. The shorter vertical portions are returned to form eyes 38 which lie in planes generally perpendicular to the door for receiving portions of the movable frame to permit its pivotal movement. The frame is fastened to the inside of the cupboard door 14 by four brackets 40, two of which are located between the top portion 26 and wire side members 32, the other two being located over vertical portions 36.

Figure 6:
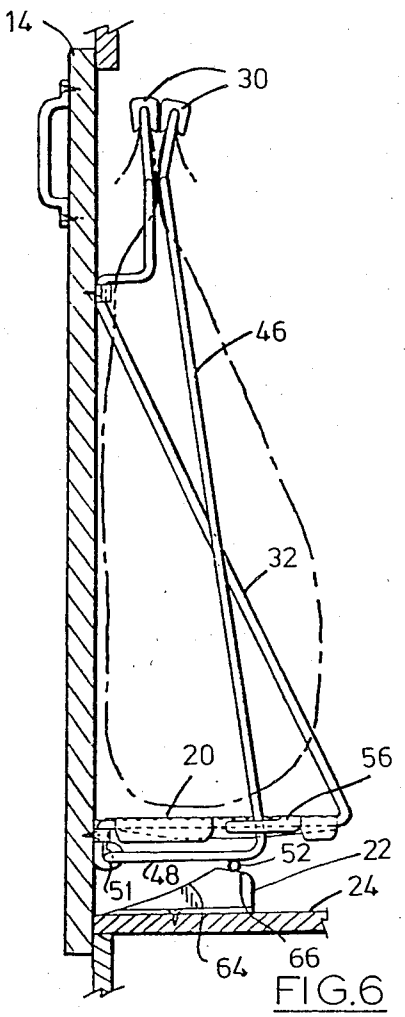
FIGS. 4, 5 and 6 are end sectional views drawn to a slightly larger scale and showing the garbage bag holder in fully opened, partially closed and completely closed positions.
Figure 5:
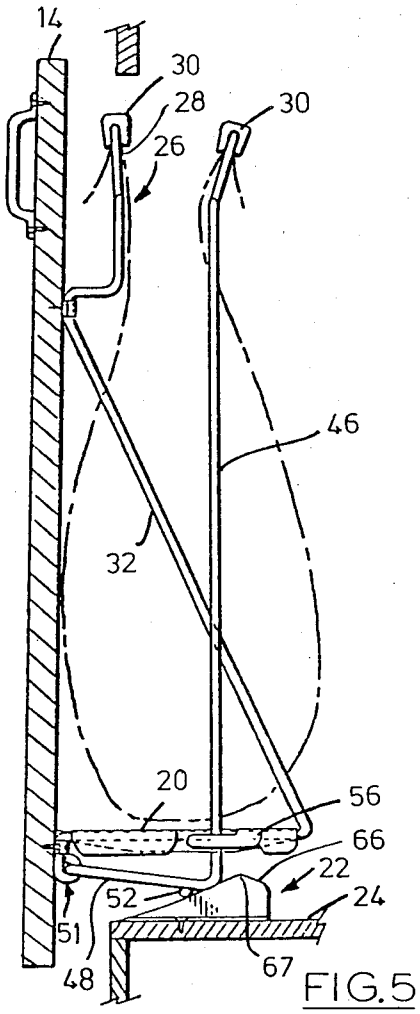
Figure 4:
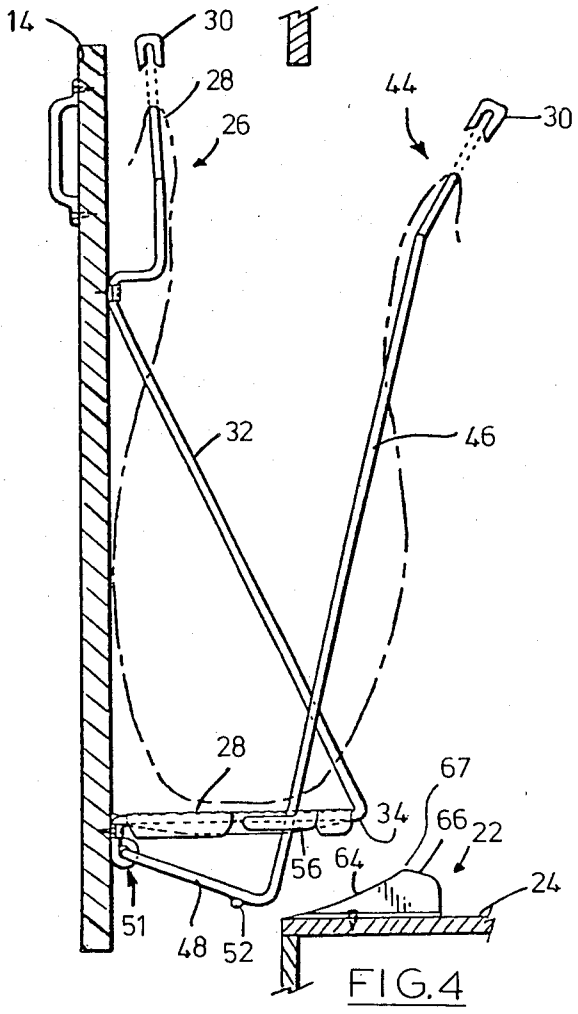

The moveable frame 16 consists of a top handle portion 44 of similar size and shape to portion 26 of the fixed frame portion and carries an identical plastic cap 30. The top portion is joined to two wire side members 46 which, as best seen in FIGS. 4–6, lie in a plane inclined to that of the handle portion so that when the bag holder is closed, top portions 26 and 44 lie adjacent to each other as shown in FIG. 6 to provide closure of the top of the garbage bag. Each side wire 46 is bent to form a lower portion 48 which, when the door is closed as seen in FIG. 6, is horizontal. Each lower portion 48 is bent through 90° at its end to form a shorter hooked portion 50 which is located in a respective eye 38 to form a pivotable connection 51 (FIG. 2) so that frame 16 is freely pivotable relative to the fixed frame 12 about a corresponding pivot axis. A coil spring 49 is mounted between a respective vertical portion 36 and hooked portion 50 to force the movable frame to a fully open position when stiff paper bags are used. A horizontal wire rod 52 is spot welded to the underside of lower portions 48 and defines a leading ramping portion for contacting the closure ramp 22 to open and close the bag holder as the cupboard door is opened and closed.

The removable tray 20 is dished downwardly and has preformed side channels 54 proportioned to fit over respective horizontal members 34. Each side channel has a respective lug 56 extending outwardly of the channel and defining a recess 58 for receiving a respective side wire 46. The depth of the recess sets the maximum angle to which the movable frame can open under gravity as the door is opened and, of course, the size of the opening of the bag. The tray 20 can be removed from the bag holder by lifting it upwardly and away from the door, as shown in broken outline, to permit cleaning and the like.

The closure ramp 22 is made of plastic and is screwed onto the floor provided by the base of the cabinet. It consists of a generally flat base portion 60 with an integral upstanding ramp portion 62 which has a long upwardly inclined ramp surface 64 for engaging with the horizontal rod 52 to force the bag holder closed as the door is closed and a shorter downwardly inclined ramp surface 66 joining the longer surface at a crest 67 that acts to 'lock' the horizontal rod to keep the cupboard door firmly shut in the closed position.

Figure 2:
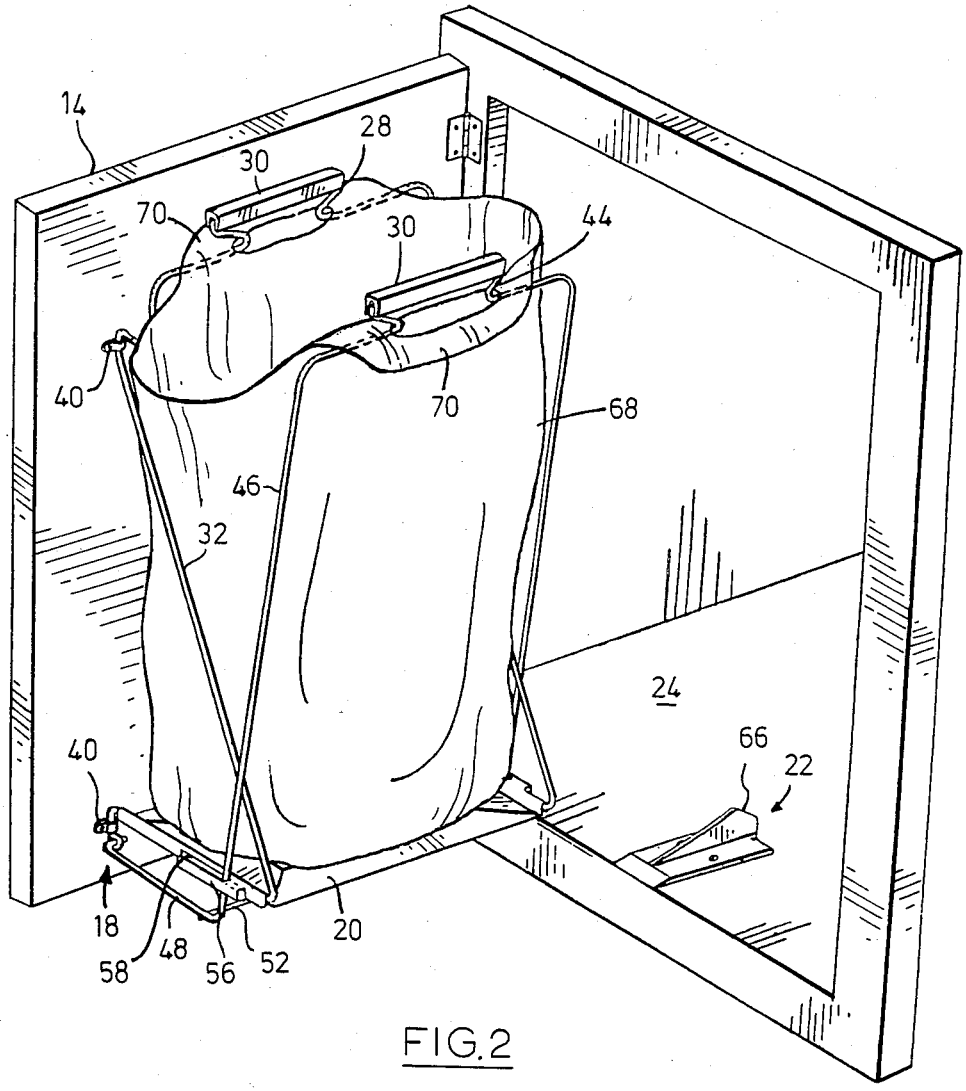
FIG. 2 is a view similar to FIG. 1 showing a bag with handles mounted in the garbage bag holder.
Figure 3:
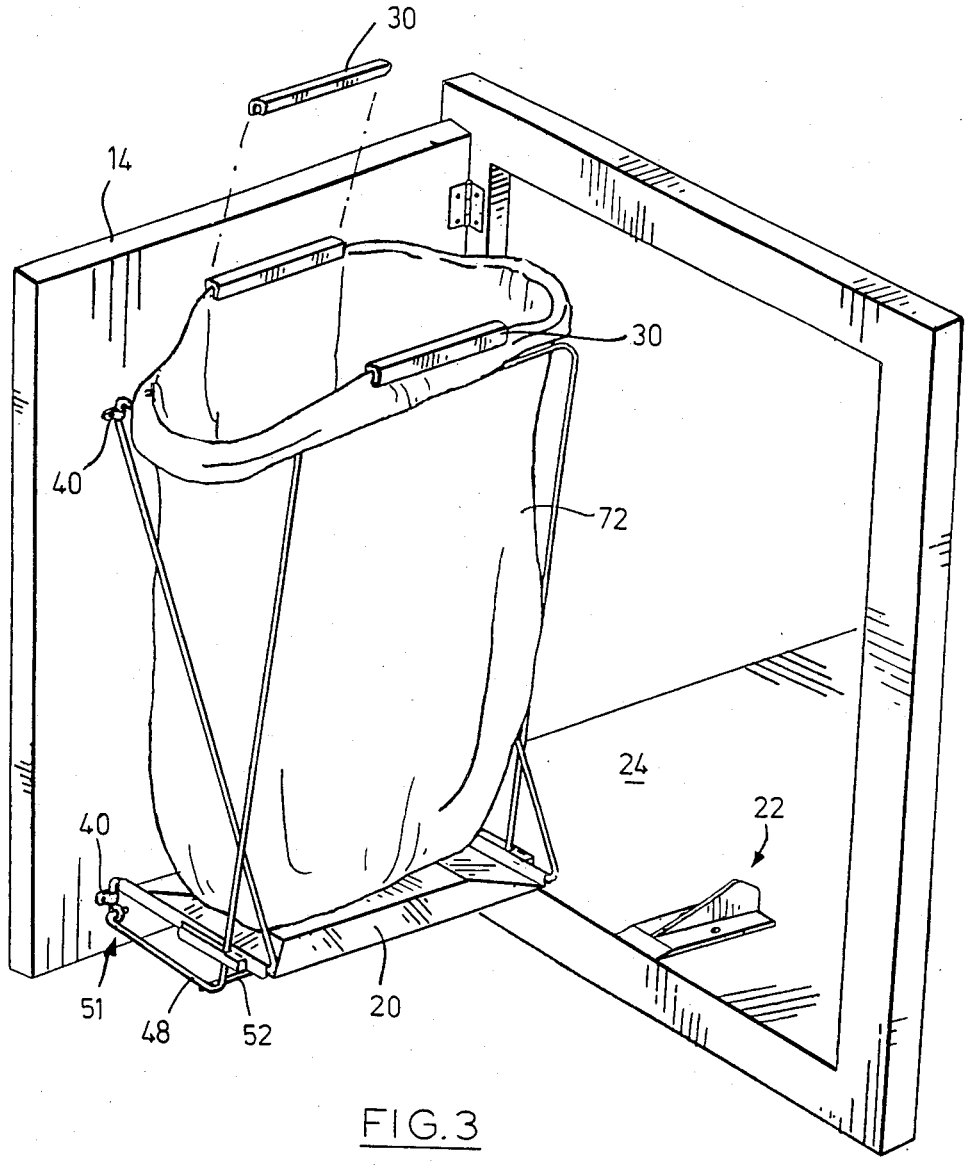
FIG. 3 is a similar view to FIG. 2 showing a bag without handles mounted in the garbage bag holder.

Reference is now made to FIG. 2 in which it can be seen that each of the handle portions 28,44 is shaped to receive handled bags 68, the handles 70 of the bags being looped over the handle portions 28,44 without removal of the caps. FIG. 3 shows a handleless bag 72 fitted in the garbage bag holder. In this case the plastic caps have been removed (one of which is shown removed for clarity) the bag located in the frame and its edges wrapped over the handle portions and the caps then snap-fitted over the handle portions.

Operation of the garbage bag holder will be described in more detail with reference to FIGS. 4, 5 and 6. FIG. 4 shows the garbage bag holder with a garbage bag shown in broken outline when the cupboard door is opened. In this position the moveable frame portion 16 forced to a position as shown under gravity and the magnitude of the opening is determined by the engagement of the side wires 46 in the recess 58, as described above. Referring to FIG. 5, as the door is closed and the horizontal rod 52 contacts the ramp surface 64 it rises up the ramp and forces the frame member 16 to pivot about pivotal connectors 51 towards the cupboard door thus closing the garbage bag holder. When the door is fully closed as shown in FIG. 6, the horizontal rod 52 has riden up the ramp surface 64 and over crest 67. This 'locks' the frame portion 16 to fully close the garbage bag holder and thus any garbage bag mounted therein, and 'locks' the movable frame portion in place and causes the cupboard door to be kept firmly shut in the closed position. The ramp surface 64 also supports the door against the weight of the garbage bag and takes the load of the hinges. The dimensions of the ramp surfaces and wire frame 16 are selected and proportioned to keep the cupboard door firmly closed when the horizontal rail is over the crest 67, also resulting in effectively sealing the garbage bag.

Figure 7:
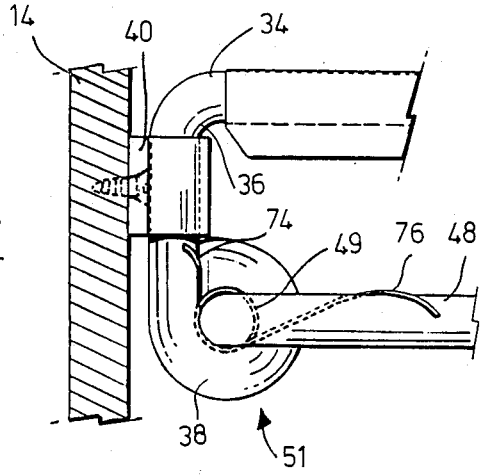
FIG. 7 is an enlarged detailed view taken in the line 7—7 of FIG. 1 showing a spring for forcing the garbage bag holder open when stiff bags are used.

FIG. 7 shows an enlarged view taken on line 7—7 of the pivotal connection 51 and showing in more detail the spring 49 for forcing the movable frame 16 fully open. The coiled spring 49 is mounted on the hooked portion 50 and has spring ends 74,76 which respectively engage the vertical portion 36 and lower portion 48 and is biased to force the movable frame portion 16 to an open position as shown in FIG. 4. As mentioned above, this is advantageous when stiff garbage bags are used, for example paper grocery bags, so that they are positively moved to an open position.

Various modifications may be made to the embodiment hereinbefore described without departing from the scope of the invention. For example, it will be appreciated that the ramp closure member 22 may be located at any position on the base of the cupboard consistent with the fact that it should contact rod 52 to effect opening and closing of the garbage bag holder as described. In addition, although the frames are preferrably made of wire coated plastic, they could in fact just be made of wire or plastic and the exact shape and configuration of the frame and handles could be changed for esthetic reasons although the function and capability of use with bags with and without handles would be retained. In addition, although the tray is shown to be removable to facilitate cleaning, this could in fact be fixed in place and the tray could be made of any suitable material other than plastic.

Figure 8:
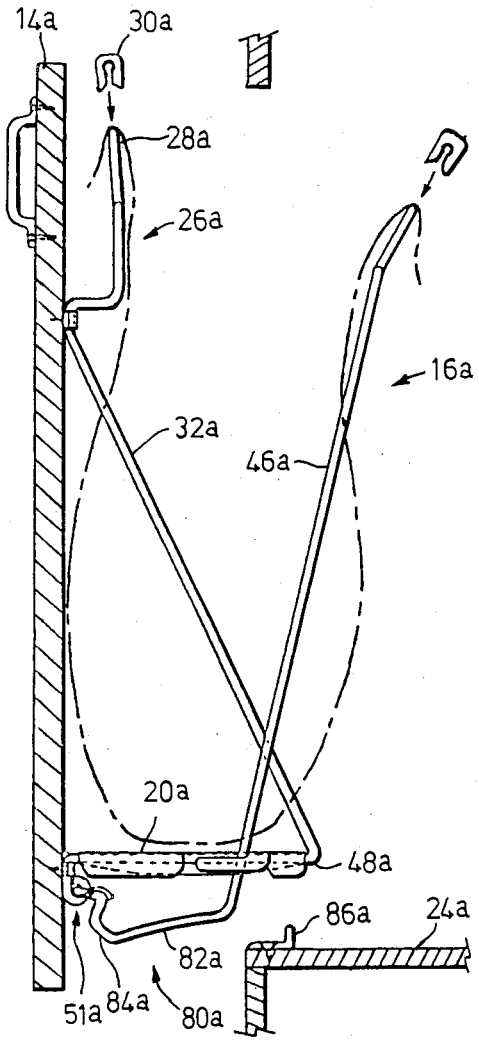
FIG. 8 is a view similar to FIG. 4 of an alternative embodiment of the invention.

An alternative structure is shown in FIG. 8 in which like numerals refer to like parts as in the preferred embodiment but with a suffix a added. Pivotable frame 16*a* is formed so that the sidewires 46*a* blend into leading ramp portions defined by shaped lower ramp portions 80*a* which has a downwardly inclined ramp portion 82*a*, and an upwardly inclined ramp portion 84*a* essentially of the same profile as ramp surface 64. A horizontal plastic rail 86*a* constituting a cooperating ramping member is shown mounted on the base of the cabinet 24*a*. In operation, as the door is closed, ramp surface 82*a* engages the horizontal rail 86*a* and forces the frame portion 16*a* to close in the same manner as shown in FIGS. 5 and 6 until upwardly inclined ramp portion 84*a* sits over the rail 86*a* to retain the garbage bag holder closed and the cupboard door firmly shut in the same manner as shown in FIG. 6.

Advantages of the invention are that the garbage bag holder always remains firmly closed when the door is closed and the requirement for a lid is obviated. In addition the over peak provision on the ramp rod or rail means that the cupboard door is always kept firmly shut in the closed position and the cooperating ramp members relieve the load on the door hinges. There is no obstruction to access to the interior of the cupboard and bags of all types, with and without handles, can be accomodated by the bag holder which is, of course, attractive from a consumer viewpoint. In addition, the base tray is readily and easily removable for cleaning purposes and the entire structure can be easily mounted to the inside of a door with minimal tools and skill. The bag holder is also biased to an open position when the door is opened by spring means so that adequate bag opening is provided even with stiff paper bags. The bag holder automatically opens and closes as the door is opened and closed and this is a considerable asset for the disabled and handicapped who need merely drop the garbage into the bag holder and close the door again.

I claim:

1. A lidless garbage bag holder comprising:

a fixed frame portion;

means for fastening the fixed frame portion to the inside vertical surface of a cupboard door mounted on a cabinet, said cabinet having a base and a cabinet floor;

a movable frame portion pivotably connected to the fixed frame portion and pivotably movable about a horizontal pivot axis relative to the first frame portion toward and away from the first frame portion and said door inside vertical surface;

respective garbage bag holding means on said fixed and movable frame portions for receiving and holding a garbage bag between them;

a ramping portion on said movable frame portion spaced further from said door inside surface than said pivot axis; and cabinet frame ramping means adapted to be fastened to said cabinet floor and engaging said movable frame portion ramping portion, whereby as said cupboard door is respectively closed and opened the engagement between said movable frame portion ramping portion and said ramping means moves the movable frame portion toward the fixed frame portion, and permits movement of the movable frame portion away from the fixed frame portion, respectively to close and open said garbage bag holder.

2. A garbage bag holder as claimed in claim 1, wherein said ramping means is located inside said cabinet on said cabinet floor, said ramping means having nearer to the door an upward ramp surface that is upwardly inclined inwardly away from the door and having further from the door a downward ramp surface that is downwardly inclined inwards away from the door and connected to said upward ramp surface by a crest, and wherein said movable frame portion ramping portion engages and rides up said upwardly inclined ramp surface to move said movable frame portion towards said fixed frame portion to close said garbage bag holder, and thereafter said ramping portion moves over said crest to lie on said downwardly inclined ramp surface to retain the garbage holder closed and the cupboard door firmly shut in the closed position.

3. A lidless garbage bag holder as claimed in claim 1, wherein said movable frame portion is shaped to provide said ramping portion, said ramping portion having a first downwardly inclined ramp portion and a second upwardly inclined ramp portion which is connected to said downwardly inclined portion by a crest, said cabinet frame ramping means consists of a rail member located inside said cabinet on said cabinet floor, and said ramping portion and said rail member are proportioned and arranged so that as said cupboard door is closed said first downwardly inclined ramp portion firstly engages said rail member and forces said movable frame portion to pivot about said pivot axis towards said fixed frame portion and close, and thereafter said peak moves over said rail member so that said upwardly inclined ramp portion lies against said rail member to retain the garbage bag holder closed and the cupboard door firmly shut in the closed position.

4. A lidless garbage bag holder as claimed in claim 1, wherein each garbage bag holding means consists of a respective shaped handle portion and a respective resilient cap for snap-fitting over said shaped handle portion, said handle portions being adapted to receive bags with handles which loop over said handle portions, and to receive bags without handles which are wrapped over said handle portions and retained thereon by said resilient caps snap-fitted over the handle portions.

5. A lidless garbage bag holder as claimed in claim 1, and including a tray removably mounted on said fixed frame portion, said removable tray having at each side thereof recess means receiving respective parts of said movable frame portion and in which said respective parts are movable toward and away from the door, the said parts being engagable with the recess end walls to define the maximum opening of said garbage bag holder when said cupboard door is opened.

6. A lidless garbage bag holder as claimed in claim 1, including spring biasing means mounted between said movable frame portion and said fixed frame portion, said spring biasing means acting to urge said movable frame portion to pivot to a fully open position when said cupboard door is opened.

7. A lidless garbage bag holder comprising:

a fixed frame portion;

means for fastening the fixed frame portion to the inside vertical surface of a cupboard door mounted on a cabinet, the cabinet having a base and a cabinet floor;

a movable frame portion pivotably connected to said first frame portion about a horizontal pivot axis and pivotably movable relative to the first frame portion, said movable frame portion having a horizontal rod connected at its lower end spaced further from the door vertical surface than the pivot axis;

a garbage bag holder closure ramp located inside said cabinet frame on said cabinet floor;

the ramp having an upwardly inclined ramp surface and a downwardly inclined ramp surface connected to said upwardly inclined ramp surface by a crest, the ramp being engagable by the horizontal rod whereby when said cupboard door is being closed the rod engages and rides up said upwardly inclined ramp surface, forcing said garbage bag holder to close, and when the rod has moved over said crest to lie on said downwardly inclined ramp surface it acts to retain the garbage holder closed and the cupboard door firmly shut in the closed position;

garbage bag holding means on each of said fixed and movable frame portions consisting of a respective shaped handle portion and a respective resilient cap for snap-fitting over said shaped handle portion, said handle portions being adapted to receive bags with handles which loop over said handle portions and bags without handles which are wrapped over said handle portions and retained thereon by said resilient snap-fitted caps;

a tray removably mounted on said fixed frame portion, said removable tray having at each side thereof recess means receiving respective parts of said movable frame portion and in which said parts are movable toward and away from the door, the said parts being engagable with the recess end walls to define the maximum opening of said garbage bag holder when said cupboard door is opened; and spring biasing means mounted between said movable frame portion and said fixed frame portion, said spring biasing means acting to urge said movable frame portion to a fully open position when said cupboard door is opened.

* * * * *